United States Patent [19]

Clarke et al.

[11] 4,008,989

[45] Feb. 22, 1977

[54] BOLT SEAL FOR ROTARY PISTON MACHINE

[75] Inventors: John Michael Clarke, Banbury; David Stuart Gilchrist, Harwich, both of England

[73] Assignee: Caterpillar Tractor Co., Peoria, Ill.

[22] Filed: Oct. 10, 1975

[21] Appl. No.: 621,428

[30] Foreign Application Priority Data

Oct. 10, 1974 United Kingdom ..... 43856/74

[52] U.S. Cl. ..... 418/120; 418/51

[51] Int. Cl.[2] ..... F04C 27/00

[58] Field of Search ..... 418/119, 120, 121, 122, 418/123, 124, 142, 51

[56] References Cited

UNITED STATES PATENTS

| | | | |
|---|---|---|---|
| 3,485,218 | 12/1969 | Clarke | 418/53 |
| 3,830,600 | 8/1974 | Shimoji et al. | 418/122 X |

*Primary Examiner*—C. J. Husar
*Assistant Examiner*—Leonard Smith
*Attorney, Agent, or Firm*—Gifford, Chandler, Sheridan & Sprinkle

[57] ABSTRACT

A rotary piston machine of the type having a slant or precessing rotor or the type having a parallel axis rotor, such as a Wankel engine, having a rotor seal grid formed from peripheral and apex seals extending around surfaces of the rotor and together defining closed working chambers in a housing in which the rotor is rotatable, adjacent ends of the seals being connected together by connectors, often called bolts, located in sockets in the rotor. Each bolt has clearance laterally of its longitudinal axis from the peripheral wall of the socket to permit lateral movement of the bolt in the socket except in one direction laterally of the longitudinal axis of the bolt, in which direction, movement of the bolt is restrained by the bolt being held between fixed laterally opposite positions engaging its peripheral surface.

5 Claims, 5 Drawing Figures

BOLT SEAL FOR ROTARY PISTON MACHINE

BACKGROUND OF THE INVENTION

1. Field of the Invention

The invention relates to a rotary piston machine, which term includes an internal combustion engine, pump or compressor of either the type having a slant axis or precessing rotor or the type having a parallel axis rotor, the Wankel engine being an example of the latter type.

2. Description of the Prior Art

In either type of machine, the rotor carries a grid of seals which engage internal walls of the housing in which the rotor rotates and which define therein separated working chambers. The portion of the grid bounding each working chamber is usually formed from a plurality of apex seals spaced apart around the rotor axis in a general circumferential direction of the rotor and a plurality of peripheral seals spaced apart in a general direction axially of the rotor. Co-operating peripheral and apex seals are connected together at their adjacent ends by a connector often called a link block or bolt (and hereinafter called a "bolt") inserted into a socket in the rotor, the adjacent ends of the seals being slotted or abutted against the peripheral surface of the bolt.

As the apex seals change in their inclination to a radial plane as the rotor turns as a result of the outer edges of the apex seals "wiping" against the housing, the bolts must be permitted to rock in their respective sockets. To permit this rocking movement clearance must be provided between the peripheral walls of the bolt and its socket. A large clearance is desirable from the manufacturing aspect because substantial tolerances can be permitted. However large tolerances would cause uncertainty in the position of the point of contact between the bolt and the housing and this could result in undesirable load sharing between the rotor, the bolts, the seals and the housing. An object of the invention is to provide a seal arrangement in which substantial tolerances are permissible without said uncertainty as to the position of the point of contact of each bolt and its socket.

SUMMARY OF THE INVENTION

According to the invention, a rotary piston machine includes a rotor seal grid comprising a plurality of peripheral and apex seals extending around surfaces of the rotor and together defining closed chambers in a housing in which the rotor is rotatable, adjacent ends of adjacent seals being connected together by a bolt, as herein defined, located in a socket in the rotor, each bolt having clearance laterally of its longitudinal axis from the peripheral wall of the socket to permit lateral movement of the bolt in the socket except in one direction laterally of the longitudinal axis of the bolt, in which direction, movement of the bolt is restrained by the bolt being held between fixed laterally opposite positions engaging its periperal surface. The fixed positions may be in the peripheral wall of the socket or on a fixed seal and a fixed position in the peripheral wall of the socket opposite said fixed seal.

Where the bolt is held between two laterally opposite fixed positions in the peripheral wall of the socket, the bolt may be of substantially elliptical shape in lateral cross-section, the major axis of the ellipse extending in the direction in which lateral movement of the bolt is to be restrained and abutting or being in close proximity to diametrically opposite positions in the peripheral wall of the socket which is circular in lateral cross-section.

Alternatively, the socket may be of substantially elliptical shape and the bolt may be of circular shape in lateral cross-section, the minor axis of the ellipse extending in the direction in which lateral movement of the bolt is to be restrained and the diameter of the bolt being of length such that diametrically opposite positions in the peripheral wall of the bolt contact or are in close proximity to the peripheral wall of the socket across its minor axis.

Where the bolt is held between a fixed seal and an opposite position in the peripheral wall of the socket, both the socket and the bolt may be of circular shape in lateral cross-section, the diameter of the socket being greater than the diameter of the bolt and the fixed seal extending into the socket and holding the longitudinal axis of the bolt displaced laterally from the longitudinal axis of the socket.

The fixed seal is conveniently a peripheral seal.

BRIEF DESCRIPTION OF THE DRAWINGS

By way of example, several seal arrangements for a rotary piston machine are now described with reference to the accompanying drawings, in which.

DESCRIPTION OF THE PREFERRED EMBODIMENTS

Figure 1:
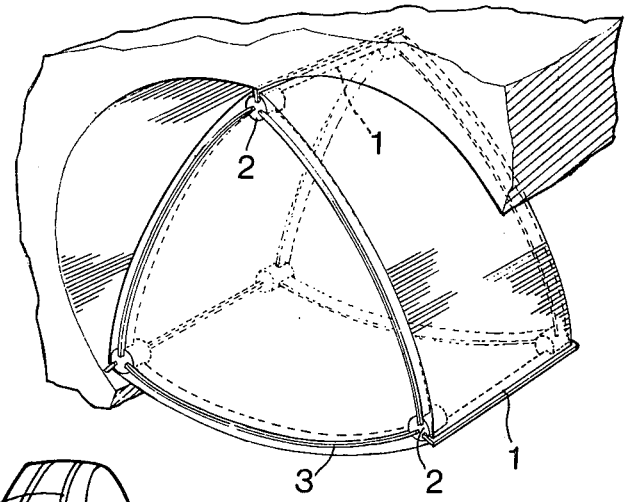
FIG. 1 is a diagram showing a typical known arrangement of seals for a rotary piston engine of the parallel axis rotor or Wankel type.

Referring first to FIG. 1, the typical seal arrangement in a rotary piston engine of the Wankel type includes three apex seals 1 mounted one at each of the three corners of the rotor and extending along the edge of the corner and parallel with the axis of rotation of the rotor. The apex seals are slotted into the edges of the corners of the rotor and into bolts 2 of generally cylindrical shape located in sockets in the rotor at each corner and adjacent the end faces. The seal arrangement is completed by a pair of peripheral seals 3 mounted on the periphery of the rotor and extending between the apex seals. Thus a sealing grid is formed around the rotor by the apex seals 1, the peripheral seals 3 and the bolts 2. The radially outer edges of the apex seals 1 and the outer faces of the peripheral seals 3 engage the internal walls of the housing in which the rotor is mounted and thus define in the housing separated working chambers as the rotor turns therein.

Figure 2:
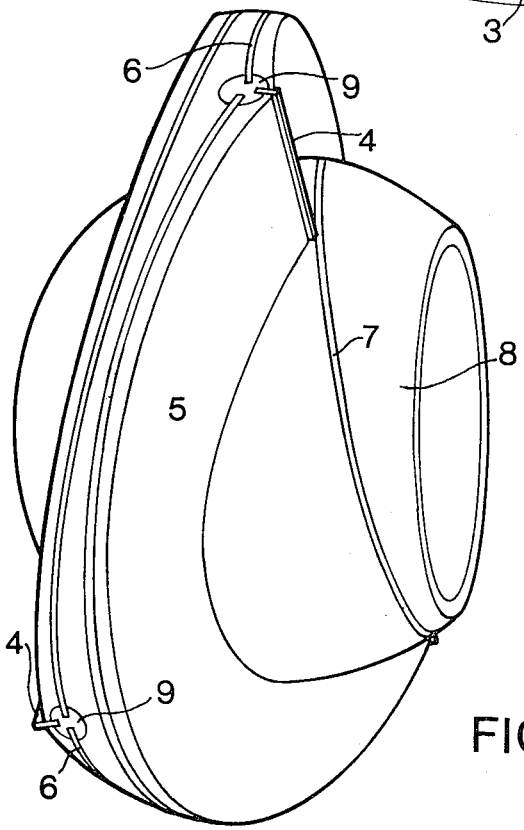
FIG. 2 is a diagram showing a typical known arrangement of seals for a rotary piston engine of the slant axis or precessing rotor type.

Referring now to FIG. 2, the typical seal arrangement in a rotary piston engine of the slant axis or precessing rotor type comprises a grid formed from apex seals 4 slotted in the rotor 5, peripheral seals 6 extending along the rim of the rotor and peripheral seals 7 extending along the hub 8 of the rotor, the latter being of spherical shape. The apex seals 4 and the peripheral seals 6 are slotted into bolts indicated at 9 located in sockets in the rotor.

Figure 3:
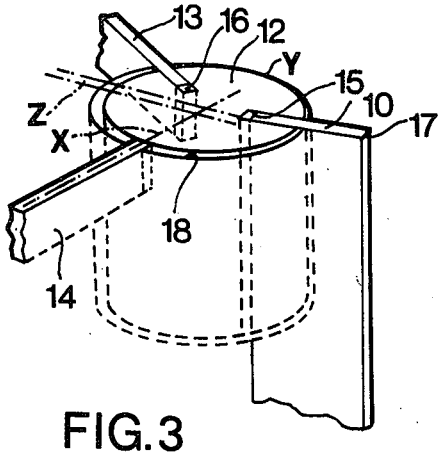
FIG. 3 is a perspective view to a larger scale of a seal bolt at a corner of a first seal arrangement in either type of engine and in accordance with the invention.

In accordance with the invention, a seal arrangement at each corner of the seal grid, i.e., where an apex seal and two peripheral seals are to be connected, is shown in FIG. 3 and comprises an apex seal 10 slotted into the rotor 11 and into a cylindrical bolt 12. A pair of peripheral seals 13, 14 are similarly slotted in the rotor 11 but only the peripheral seal 13 is slotted in the bolt 12. The other peripheral seal 14 abuts the periphery of the bolt 12 and is fixed from movement radially of the bolt 12. The seals 10 and 13 are slidable radially of the bolt 12 in their respective slots 15, 16. The longitudinal center lines of the seals 10, 13 and 14 are disposed around the longitudinal axis of the bolt 12.

The apex seal 10 also has freedom to move sideways in the slot in the rotor 11 as it wipes at its radially outer edge 17 against the housing walls defining the working chambers as the rotor turns. To accommodate movement of the apex seal 10 in its slot and thermal expansion of the rotor, the bolt and the seals, the bolt 12 has a smaller diameter than the socket 18 in the rotor 1 in which the bolt 12 is received. Lateral movement of the bolt 12 along the center-line X of the fixed peripheral seal 14 is prevented or limited by so positioning the seal 14 that it extends at its inner edge 19 into the socket and abuts the bolt 12, thereby displacing the bolt 12 laterally in the socket so that it abuts the socket wall at or near a diametrically opposite point Y in the socket wall between the seals 10 and 13. Thus the longitudinal axis of the bolt 12 is displaced by a distance Z from the longitudinal axis of the socket 18. Although the bolt 12 is restrained from lateral movement along the center-line X, it can expand or otherwise move in other directions, the apex seal 10 and the peripheral seal 13 being relatively slidable in their respective slots 15, 16. By offsetting the longitudinal axis of the bolt 12 from the longitudinal axis of the socket 18, substantial manufacturing tolerances are permissible for the diameters of the bolt 12 and the socket 18 and by using the fixed seal 14 to hold the bolt 12 in contact with or in close proximity to the point Y in the peripheral wall of the socket 18, the contact point Y is located in or close to an ideal position between the center-lines of the seals 10 and 13, instead of being freely movable around the peripheral wall of the socket, as it would if the bolt 12 were permitted complete freedom to wobble or move eccentrically in all directions in the socket 18. This provides good support for the bolt 12 without excessive loading on the apex seal 10 and the seal 13.

Figure 4:
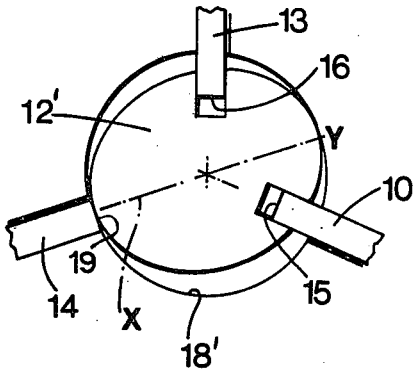
FIG. 4 is a plan view of another seal bolt arrangement for either type of engine and in accordance with the invention.
Figure 5:
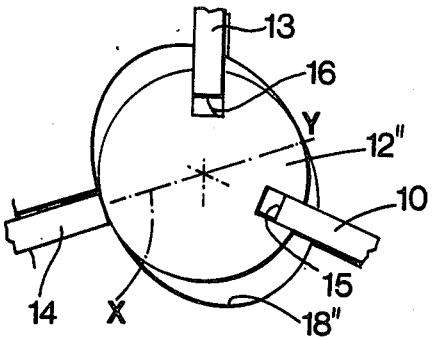
FIG. 5 is a plan view of yet another seal bolt arrangement for either type of engine and in accordance with the invention.

As already stated, the bolt may be constrained from movement along the center-line X by making either the bolt or the socket 18 substantially elliptical instead of truly circular in lateral cross-section. FIGS. 4 and 5 show two alternative configurations in which the ellipticity of the bolt and socket, respectively, has been exaggerated.

In FIG. 4 the bolt 12′ is of substantially elliptical shape in lateral cross-section, the major axis of the ellipse extending across a diameter of the socket 18′ which is of circular shape in plan in the direction in which lateral movement of the bolt is required to be restrained.

In FIG. 5, the bolt 12″ is of circular cross-section and the socket 18″ is of substantially elliptical shape in plan, the minor axis of the ellipse extending across a diameter of the bolt 12″ in the direction in which lateral movement of the bolt is required to be restrained.

In FIGS. 4 and 5 the seals have been shown as in FIG. 3, and have been given the same reference numerals as in that Figure. Further description is therefore unnecessary.

Although the foregoing description refers to an internal combustion engine a similar sealing arrangement may be employed in a rotary piston machine in which there is no combustion, for example, in a compressor or a pump.

What we claim as our invention and desire to secure by Letters Patent of the United States is:

1. A rotary piston machine comprising a housing, a rotor mounted thereon, and a rotor seal grid comprising a plurality of peripheral and apex seals extending around surfaces of said rotor and together defining closed working chambers in said housing, a plurality of generally cylindrical seal connectors (herein called a bolt) by which adjacent ends of adjacent seals are connected together, each said bolt, located in a respective socket in said rotor and each bolt having clearance laterally of its longitudinal axis from the peripheral wall of the respective socket to permit lateral movement of said bolt in said socket except in one direction laterally of the longitudinal axis of said bolt, in which direction, movement of said bolt is restrained by said bolt being held between fixed laterally opposite positions engaging its peripheral surface.

2. A rotary piston machine as claimed in claim 1 in which each said bolt is held between two laterally opposite fixed positions in the peripheral wall of the respective socket, said bolt being of substantially elliptical shape in lateral cross-section, the major axis of the ellipse extending in the direction in which lateral movement of said bolt is to be restrained and abutting or being in close proximity to diametrically opposite positions in the peripheral wall of the socket which is circular in lateral cross-section.

3. A rotary piston machine as claimed in claim 1 in which each said bolt is held between two laterally opposite fixed positions in the peripheral wall of the respective socket, said socket being of substantially elliptical shape in lateral cross-section and said bolt being of circular shape in lateral cross-section, the minor axis of the ellipse extending in the direction in which lateral movement of said bolt is to be restrained and the diameter of said bolt being of length such that diametrically opposite positions in the peripheral wall of said bolt contact or are in close proximity to the peripheral wall of said socket across its minor axis.

4. A rotary piston machine as claimed in claim 1 in which each said bolt is held between a fixed said seal and a laterally opposite position in the peripheral wall of the respective socket, both said socket and said bolt being of circular shape in lateral cross-section and the diameter of said socket being greater than the diameter of said bolt and said fixed seal extending into said socket and holding the longitudinal axis of said bolt displaced laterally from the longitudinal axis of said socket.

5. A rotary piston machine as claimed in claim 4 in which said fixed seal is a peripheral seal.

* * * * *

UNITED STATES PATENT AND TRADEMARK OFFICE

CERTIFICATE OF CORRECTION

PATENT NO. : 4,008,989

DATED : February 22, 1977

INVENTOR(S) : John Michael Clarke and David Stuart Gilchrist

It is certified that error appears in the above-identified patent and that said Letters Patent are hereby corrected as shown below:

Column 1, line 50, after "closed" and before "chambers", insert --working--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*